United States Patent [19]

Lenk

[11] 4,017,249

[45] Apr. 12, 1977

[54] MELT SPINNING APPARATUS

[75] Inventor: Erich Lenk, Remscheid, Germany

[73] Assignee: Barmag Barmer Maschinenfabrik Aktiengesellschaft, Wuppertal, Germany

[22] Filed: June 13, 1975

[21] Appl. No.: 586,539

Related U.S. Application Data

[63] Continuation of Ser. No. 401,535, Sept. 27, 1973, abandoned.

[30] Foreign Application Priority Data

Oct. 5, 1972 Germany ..... 2248757

[52] U.S. Cl. ..... 425/382.2

[51] Int. Cl.[2] ..... B29C 23/00

[58] Field of Search ..... 425/146, 382.2

[56] References Cited

UNITED STATES PATENTS

| | | | |
|---|---|---|---|
| 1,993,816 | 3/1935 | Wills | 425/198 X |
| 2,969,561 | 1/1961 | McCormick et al. | 425/382.2 X |
| 3,405,425 | 10/1968 | Buckley et al. | 264/171 X |
| 3,480,706 | 11/1969 | Carpenter et al. | 425/382.2 X |
| 3,518,337 | 6/1970 | Nicolas | 264/171 X |
| 3,672,800 | 6/1972 | Rapisarna | 425/382.2 X |
| 3,715,416 | 2/1973 | Campbell et al. | 425/198 X |
| 3,861,841 | 1/1975 | Hanning | 425/146 |

*Primary Examiner*—Gerald A. Dost
*Attorney, Agent, or Firm*—Johnston, Keil, Thompson & Shurtleff

[57] ABSTRACT

Melt spinning apparatus for producing polymer filaments from a plurality of spinning nozzle units connected in parallel to a common melt extruder through a common metering pump and filter arranged in sequence in the melt feed line, each spinning nozzle unit having individual pressure regulating means at its feed side such as a throttle, adjustable valve or the like.

4 Claims, 1 Drawing Figure

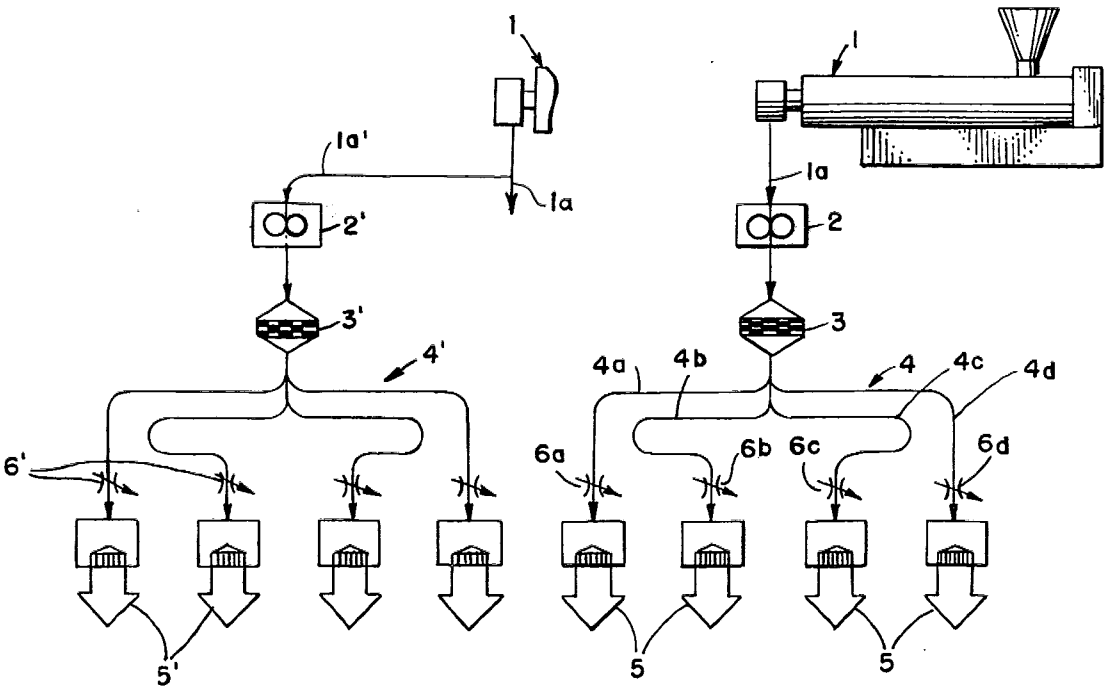
1
1a
2
3
4
4a
4b
4c
4d
6a
6b
6c
6d
5
5
1
1a
1a'
2'
3'
4'
6'
5'

MELT SPINNING APPARATUS

This is a continuation of application Ser. No. 401,535, filed Sept. 27, 1973 and now abandoned.

It is generally known that one can supply a polymer melt from a central extruder over a melt distribution conduit system to a series of parallel-connected spinning nozzle units, i.e. individual spinning heads having a die with spinning orifices in order to simultaneously produce a large number of polymer filaments. The spun filaments are then conducted from each spinning nozzle for subsequent fiber-forming steps such as a drawing or stretching operation and other well known procedures to obtain a melt-spun thread, yarn or similar multi-filament product which is then spooled.

It is also known that one can employ a single metering pump in order to feed all of the parallel spinning nozzle units in one branched distribution system. However, even though a constant amount of melt can be conveyed by this single metering pump for common distribution, the resulting spun filaments do not exhibit a satisfactory uniformity with respect to their titer, i.e. their filament or yarn size. This disadvantage is quite serious and arises primarily from the fact that each spinning nozzle, according to the number of individual spinning orifices therein, spins a corresponding number of individual continuous molten filaments adjacent to one another for separation into the individual filaments, at least until they solidify or harden sufficiently to avoid sticking together. Even slight variations in melt pressure from nozzle unit to nozzle unit produces a relatively large titer variation at the spinning orifices which regulate the yarn or filament size.

With the melt spinning of multi-filament threads or yarns from a nozzle, the danger of excess variation of the individual filaments is still relatively great and leads to undesirable titer deviations, i.e. with reference to filament size. Even in the spinning of a monofilament, the variation in diameter or titer of the single filament is brought about partly by occasional obstructions of the spinning orifice. Also, good titer or yarn size uniformity is not to be obtained with a pure central metering of the required amounts of melt because it is not possible to maintain every filter resistance so uniform that the individual melt amounts arriving at the nozzles will be uniform. At the same time, one cannot try to use a separate metering pump for each spinning nozzle unit because this is too expensive and generally also fails to produce uniform filament sizes at each separate unit due to the difficulty in synchronizing or producing uniform pressures of the separately run metering pumps.

The object of the present invention is to provide a melt spinning apparatus comprising a number of individual spinning nozzle units connected in parallel to a common metering pump together with means to ensure a reasonably uniform amount of melt being delivered to each spinning nozzle unit and also to ensure a sufficiently uniform titer or size of the spun filaments.

According to the present invention, this object is achieved by a particular combination and arrangement of the elements of a melt spinning apparatus as defined more fully hereinafter in conjunction with the accompanying drawing which provides a schematic representation of the invention.

IN THE DRAWINGS

FIG. 1 is a flow sheet illustration of a melt spinning apparatus of the invention wherein a common extruder feeds the polymer melt to a first set or combination of spinning units; and FIG. 2 is another flow sheet illustration based on FIG. 1 with parts omitted while adding a second set or combination of spinning units being fed from said common extruder.

Thus, it has now been found that a substantial improvement can be achieved in a melt spinning apparatus or combination having a central metering pump with a capacity sufficient to feed polymer melt to a plurality of parallel connected spinning nozzle units, provided that a central filter for the melt is connected in the feed line after the metering pump and before this feed line is branched into a distributor conduit system leading to each of the individual spinning nozzle units and also provided that a pressure regulating means is located in each branched feed conduit preceding a spinning nozzle unit in the direction of melt flow.

The drawing provides an adequate schematic representation of the combination according to the invention, each individual element or part being conventional in itself and readily available for use in a commercial spinning apparatus.

Referring first to FIG. 1 of the drawing, a central extruder 1 for the initial preparation of a viscous but spinnable synthetic polymer melt, e.g. nylon or linear polyester melts or the like, has a main feed line 1*a* leading to a central metering pump 2, especially a gear wheel pump which can be operated to deliver a very constant amount of the melt. Depending upon the capacity of the extruder 1, it can be used to supply one or more additional metering pumps 2' through another main feed line 1*a'* to a second melt spinning combination as indicated in FIG. 2 wherein all elements are identical to the primary melt spinning combination as shown in FIG. 1 and discussed hereinafter in detail.

From the metering pump 2 the melt is conducted by the main feed line 1*a* to an after-connected filter 3 of conventional design for the removal of fine solid particles which still remain in the initially extruded and metered melt. The melt is then conveyed into the branched distribution system 4, i.e. into the four individual feed conduits 4*a*, 4*b*, 4*c* and 4*d* which are equal in length so as to maintain a balanced system. An individual spinning nozzle unit 5 receives the polymer melt from the corresponding branched feed conduit of the distribution system. However, before each spinning nozzle unit, there is installed an individual pressure control or throttle device 6*a*, 6*b*, 6*c* or 6*d* in the corresponding branched feed conduit.

These pressure control devices are constructed to a very exact calibration and are preferably adjustable to a suitable pressure drop or pressure gradient, for example using a variably controlled valve means. Such regulatable pressure control valves are easily arranged and quite freely accessible in the branched feed lines just before the individual spinning nozzle units and they require only a relatively small amount of space. Moreover, such valves or throttle means can be readily constructed to provide a pressure drop which is proportionately much larger than the pressure losses in the spinning nozzle units or the pressure differences of the individual spinning nozzles. Only with this arrangement and operation of the apparatus of the invention does it become possible to achieve a very uniform and equal adjustment of the amounts of melt being delivered directly into each spinning nozzle unit. The distribution of the melt and the pressure at the point of spinning are extremely satisfactory with the apparatus of the invention as evidenced by the comparatively uniform titer or yarn size of the spun filaments over the entire combination of a plurality of spinning nozzles units, i.e. the so-called "spinning heads".

By using the combination of the invention, including a single central filter of uniform resistance in combination with the central metering, any remaining variations in pressure drop are corrected by the individual pressure regulating means. This is essentially accomplished by a pressure drop of the individual pressure regulating valve or throttle itself which is proportionately large in comparison to the pressure losses over a spinning head or unit as well as in comparison to the pressure differences between the various spinning heads or units. This means for pressure regulation directly before each spinning head or unit, with reference to the direction of melt flow, also smooths out or balances unavoidable nozzle defects or disturbances inherent in these spinning devices and their operation.

This apparatus has been operated over a relatively long period of time with excellent results using conventional fiber-forming linear polymers as the melt being spun. The melt which is metered by a central gear wheel pump and conducted through the filter for distribution to the individual spinning heads or units has been observed to yield a very uniform distribution of the melt due to the additional pressure regulating means at the feed side of each spinning head or unit. The uniformity of the spun filaments, judged as individual filaments and as a spun yarn, was quite good.

The arrangement and operation of the combination according to the invention is also quite favorable in terms of a commercial installation. Further advantages reside in the fact that one can easily select a specific pressure regulation or throttle effect before each spinning nozzle unit in the melt distribution and conduction system. In addition to the accessibility of each pressure regulating device, they are easily interchanged to permit the use of simple throttle valves as well as permitting the use of variably controlled pressure regulating valves in order to adapt the combination to a wide range of polymer melts and spinning conditions.

I claim:

1. In a melt spinning apparatus for the production of polymer filaments, the combination of:

a. a plurality of spinning nozzle units connected in parallel;

b. a central extruder with a capacity sufficient to feed a polymer melt to said plurality of spinning nozzle units;

c. a central metering pump for receiving melt through a feed conduit from said central extruder and directing the metered melt through a branched conduit system to each of said spinning nozzle units;

d. a single central filter in said feed conduit line after said metering pump and before branching of said feed line into said branched conduit system for the removal of fine particles which still remain in the initially extruded and metered melt; and e. pressure regulating means located in each branched conduit preceding a spinning nozzle unit in the direction of melt flow, including means adjusting the pressure drops at these points in each branched conduit to a value proportionately substantially larger than the pressure losses in the spinning nozzle units or the pressure differences in the individual spinning nozzles.

2. A melt spinning apparatus as claimed in claim 1 wherein said central metering pump is a gear wheel pump.

3. A melt spinning apparatus as claimed in claim 1 wherein at least two sets of said plurality of spinning nozzle units are connected in parallel with said central extruder by separate feed lines, each feed line having a central metering pump followed by a central filter.

4. Apparatus as claimed in claim 1 wherein said means to adjust the pressure drops preceding each spinning nozzle unit is a variably controlled valve means calibrated to exactly adjust the amount of each pressure drop and maintain a uniform distribution of the melt to the individual spinning nozzle units.

* * * * *